US006237856B1

(12) United States Patent
Bachmann et al.

(10) Patent No.: US 6,237,856 B1
(45) Date of Patent: May 29, 2001

(54) METHOD FOR INSTALLING A STEADY RAIL TRACK

(75) Inventors: Hans Bachmann; Winfried Mohr, both of Neumarkt (DE)

(73) Assignee: Pfleiderer Infrastrukturtechnik GmbH & Co., Neumarkt (DE)

( * ) Notice: Subject to any disclaimer, the term of this patent is extended or adjusted under 35 U.S.C. 154(b) by 0 days.

(21) Appl. No.: 09/375,990

(22) Filed: Aug. 17, 1999

(30) Foreign Application Priority Data

Aug. 18, 1998 (DE) ..... 198 37 360

(51) Int. Cl.[7] ..... E01B 1/00

(52) U.S. Cl. ..... 238/7; 238/30

(58) Field of Search ..... 238/2, 5, 7, 29, 238/30

(56) References Cited

U.S. PATENT DOCUMENTS 5,435,486 * 7/1995 Geriach et al. ..... 238/7
5,653,388 * 8/1997 Pietschmann et al. ..... 238/7

* cited by examiner

*Primary Examiner*—S. Joseph Morano
*Assistant Examiner*—Robert J. McCarry, Jr.
(74) *Attorney, Agent, or Firm*—Jordan and Hamburg LLP

(57) ABSTRACT

A method for installing a steady rail track, for which the concrete railroad ties, which carry the rails or auxiliary rails and the continuous reinforcement of which protrudes below out of the only partially constructed concrete casing, are preinstalled initially into a rail grid and subsequently lined up positionally over a supporting layer and embedded in a casting composition, the rail grid, with interposing of a supporting reinforcement, which is optionally tied to the underside of the railroad tie reinforcement, being aligned directly over a hydraulically bound supporting layer and the casting composition, preferably using movable, removable side formwork, is applied on the hydraulically bound supporting layer.

20 Claims, 3 Drawing Sheets

METHOD FOR INSTALLING A STEADY RAIL TRACK

BACKGROUND OF THE INVENTION

The invention relates to a method for installing a steady rail track, for which the concrete railroad ties, which carry the rails or auxiliary rails and the continuous reinforcement of which protrudes below out of the only partially constructed concrete casing, are pre-installed initially into a rail grid and subsequently lined up positionally over a supporting layer and embedded in a casting composition.

In an earlier patent application, such an installing method has already been proposed, in which, by only the partial concreting of the concrete railroad ties and by the protrusion of their reinforcement, a better connection with the casting composition is attained and, with that, an even more advantageous vibrational behavior of the steady rail track is ensured.

For this known installation method, a concrete trough is formed initially on the hydraulically bound supporting layer of the rail track and the rail grid is aligned in this pre-concreted concrete trough with the only partially concreted railroad ties and then cast. This construction is, however, very costly since it is necessary initially to form such a concrete trough, which is necessarily itself provided with reinforcement, on the hydraulically bound supporting layer, before the railroad ties can be introduced.

SUMMARY OF THE INVENTION

It is therefore an object of the invention to provide an installing method, for which, while the railroad ties are tied in equally well and the vibrational behavior is equally advantageous, the steady rail track can be produced more simply and more quickly and at a lower cost.

To accomplish this objective, provisions are made pursuant to the invention so that the rail grid, with the interposing of a supporting reinforcement, which is optionally tied to the underside of the railroad tie reinforcement, is aligned directly over a hydraulically bound supporting layer and the casting composition, preferably using movable, removable side formwork, is applied on the hydraulically bound supporting layer.

Instead of first of all producing a concrete trough, which is stabilized by supporting reinforcement and in which the rail grid is then aligned and cast, the concrete trough or the layer replacing it is produced in the case of the inventive version of the installation method practically in one working step with the casting of the railroad ties of the rail grid. The supporting reinforcement, which represents the actual main reinforcement of the finished, steady rail track, can be placed simply on the hydraulically bound supporting layer, being kept at a distance from this supporting layer with the help of supporting feet. It can also be tied underneath directly to the railroad tie reinforcement. This also has the additional advantage that there are no interfering longitudinal joints next to the supporting walls.

The railroad ties can be one-block concrete railroad ties as well as also two-block concrete railroad ties, the reinforcement of which comprises structural steel rods, which extend essentially parallel to the railroad tie axis, are connected with one another by straps and, as connecting elements, extend continuously through the two individual blocks. This construction, for which the connecting elements then of course are ultimately embedded in the casting composition, provides particularly vibrationally elastic steady rail tracks.

The development of the invention has proven to be particularly advantageous if the reinforcement of the railroad ties, particularly of the two-block railroad ties, has so-called grid supports with in each case three longitudinal rods, forming the edges of a triangular prism, and two meandering coils, which connect these longitudinal rods. Such grid supports are commercially obtainable, so that the frequently expensive pre-manufacturing of a reinforcing basket can be omitted or limited simply to the simple connecting of several grid supports.

The alignment of the rail grid over the hydraulically bound supporting layer can be accomplished in any convenient manner, for example, also with the help of so-called portal suspensions. However, it has proven to be particularly advantageous if the height and lateral position of the rail grids are lined up over adjusting spindles. This can be accomplished, for example, by using disposable, also embedded, adjusting angle iron, which is supported for the adjustment at the hydraulically bound supporting layer and has threaded boreholes for the vertically and horizontally adjusting spindles.

To simplify the manufacture of the casting and, at the same time, to achieve water drainage to the side of the steady track, a railroad tie, for which the partial concreting is provided on top with stripping edges for the casting composition extending from one end of the railroad tie to the other at an angle to the running plane of the rails, the inclination being about 1% is provided, for carrying out the inventive installation method in a development of the invention. These inclined stripping edges can be achieved most simply owing to the fact that the whole of the upper side of the partial concreting of the railroad ties, with the exception, of course, of the rail fastening humps, is constructed as an inclined plane.

Finally, it is still also within the scope of the invention to provide the railroad ties with height markings for making a more exact locating possible during the installation.

BRIEF DESCRIPTION OF THE FIGURES

Further advantages, distinguishing features and details of the invention arise out of the following description of some examples as well as from the drawing, in which.

DETAILED DESCRIPTION OF THE INVENTION

Figure 1:
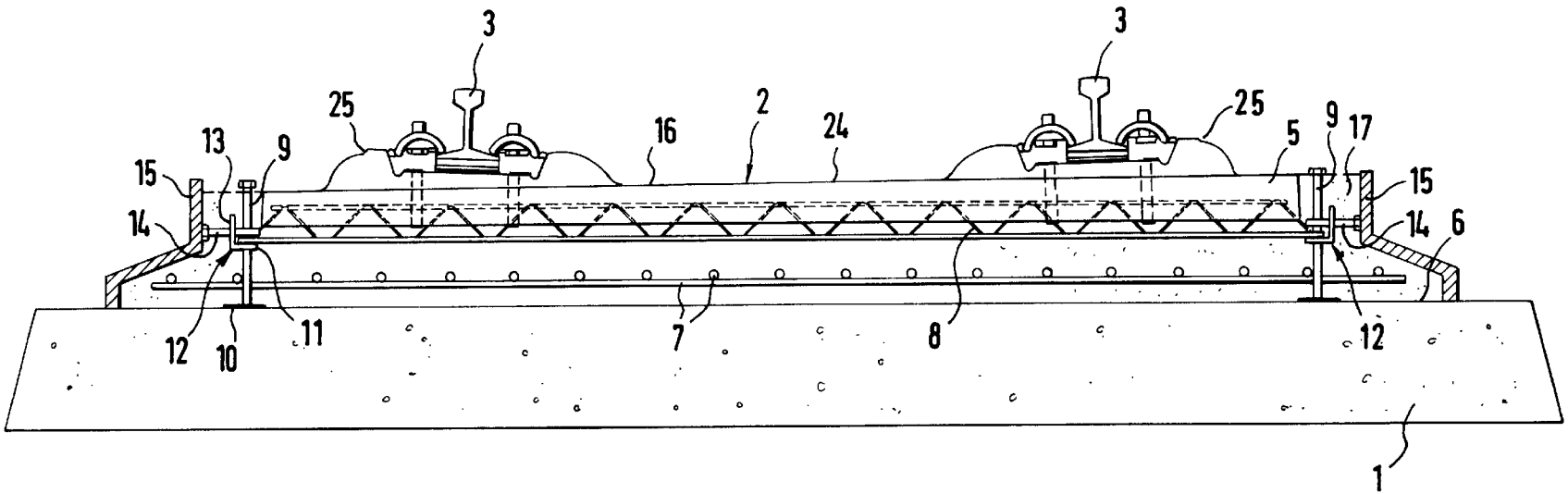
FIG. 1 shows a section through an inventive steady track immediately after the railroad ties, which are constructed, in the example shown, as one-block railroad ties with lattice girder reinforcement, are cast.

In the case of the inventive method for installing a steady rail track, a rail grid, with a plurality of concrete railroad ties 2, which are connected by rails 3 or into the rail grid and wherein the reinforcement of the concrete railroad ties protrudes at least partially from the only incompletely formed concreting 5 of the railroad ties, is so disposed over a hydraulically bound supporting layer 1, that the upper edges of the rails extend in the desired later track plane, while the reinforcement is disposed free over the surface 6 of the hydraulically bound supporting layer 1. Between the railroad ties 2 and the surface 6 of the hydraulically bound supporting layer 1, a supporting reinforcement 7 of longitudinal and transverse reinforcing rods is disposed, which in special cases can also optionally be tied directly to the underside of the reinforcement 8 of the railroad ties 2. This supporting reinforcement 7 forms the actual main reinforcement of the steady track and corresponds functionally to the reinforcement, which reinforced this concrete trough for the previous installation method with pre-manufactured concrete trough.

The adjustment of the railroad tie grid over the hydraulically bound supporting layer 1 takes place with the help of threaded spindles. The adjusting device shown comprises a height adjusting spindle 9, which is supported over a plate 10 on the surface 6 of the hydraulically bound supporting layer 1 and extends through a threaded borehole of the horizontal leg 11 of a supporting angle iron 12, on which the reinforcement 8 of the railroad tie 2 rests. A threaded spindle 14, which serves for the horizontal lateral adjustment and is supported in turn at the inside of a movable removable formwork 15, passes through the vertical leg 13 of the supporting angle iron 12, which is also provided with a threaded borehole. After the concrete railroad ties are cast, the casting composition extending in the example shown up to the upper side 16 of the partial concreting of the railroad ties, the threaded spindle 9, which serves for the vertical adjustment, is merely screwed out after an appropriate partial curing of the concrete or of the other casting composition 17. All remaining parts of the spindle adjustment device can remain in the casting composition.

Figure 2:
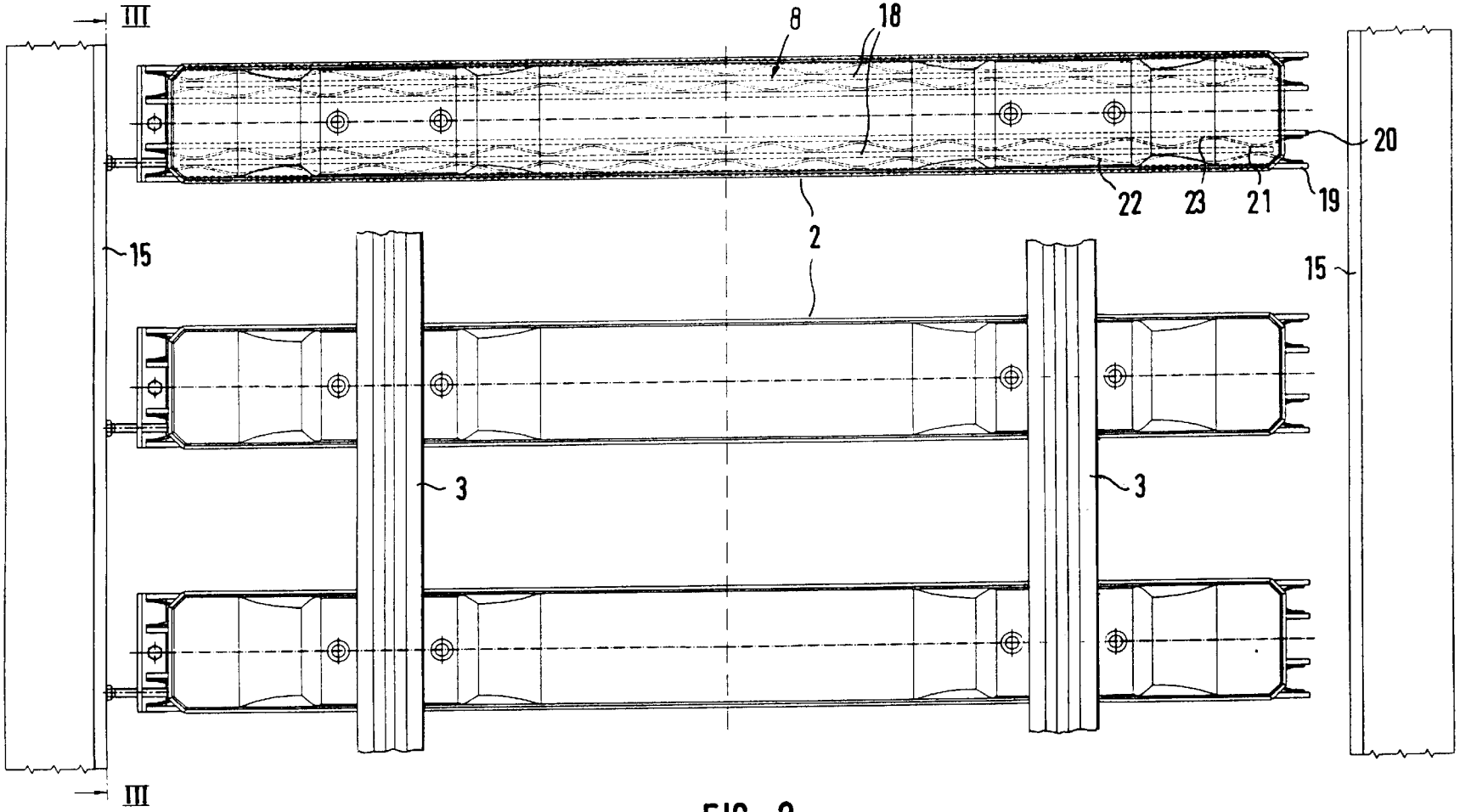
FIG. 2 shows a partial aspect of the arrangement of FIG. 1; in the top one-block concrete railroad tie shown with reinforcement partially protruding below, this lattice girder reinforcement is drawn in detail by broken lines.
Figure 3:
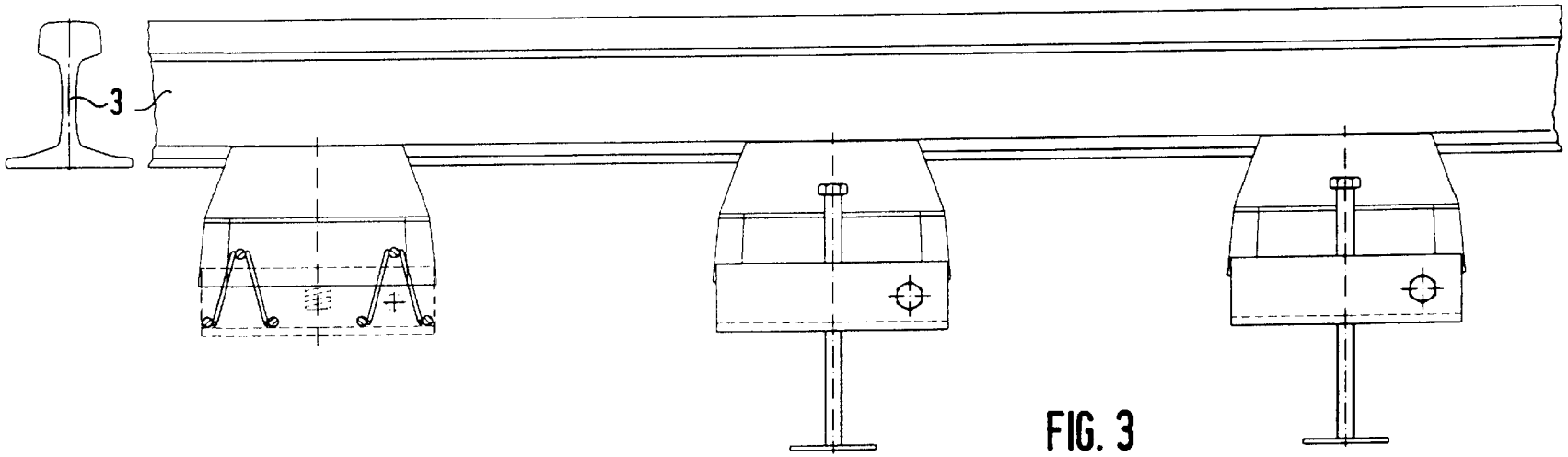
FIG. 3 shows a section along the line III—III in FIG. 2.

In FIG. 2 at the top, the construction of the reinforcement 8 of the one-block concrete railroad tie 2 can be seen clearly. It is in the form of two grid supports 18, which are disposed parallel to one another and in each case have three longitudinal rods 19, 20 and 21, which form the edges of a triangular prism, and two meandering coils 22 and 23, which connect these.

The upper edge 24 of the railroad ties 2, which serves as a stripping edge for the lean-mix concrete or the casting composition 17, is provided with an inclination of about 1% relative to the running plane of the rails, so that, after the railroad ties are installed in the steady track, an automatic water run-off from the center to the side edge of the track is guaranteed. Usually after all, two rail tracks are disposed next to one another, the installation being such that the railroad ties of the left track are inclined with their upper side towards the left and the others towards the right.

Height and length adjusting marks for improving the locating and the exact alignment by the construction crew laying the track, can be seen at 25.

The invention is not limited to the examples shown. For example, aside from further alternative possibilities for adjusting the rail grid over the hydraulically bound supporting layer 1, it would also be possible to use, instead of the one-block concrete railroad ties shown with the downwardly protruding reinforcement 8, two-block concrete railroad ties, for which the reinforcement extends continuously and is exposed between the individual blocks. Moreover, the reinforcement for the railroad ties can also be constructed differently than the preferred construction of the grid supports shown.

What is claimed is:

1. A method for installing a steady rail track, comprising: providing concrete railroad ties for carrying rails, each concrete railroad tie including a continuous railroad tie reinforcement which protrudes below out of a partially constructed concrete casing;

pre-installing the concrete railroad ties by arranging the concrete railroad ties into a rail grid and aligning the rail grid directly over a hydraulically bound supporting layer;

interposing a supporting reinforcement between the supporting layer and the rail grid; and applying a casting composition on the hydraulically bound supporting layer to embed the supporting reinforcement and concrete railroad ties in the casting composition.

2. The method according to claim 1, wherein the supporting reinforcement is tied to an underside of the railroad tie reinforcement.

3. The method according to claim 1, wherein said step of applying a casting composition includes using a movable, removable side framework to form a boundary for said casting composition.

4. The method according to claim 1, wherein said concrete railroad ties include one-block concrete railroad ties.

5. The method according to claim 1, wherein the concrete railroad ties are two-block concrete railroad ties, the railroad tie reinforcement comprising structural steel rods which extend essentially parallel to a railroad tie axis, the steel rods being connected to one another by straps and, said steel rods as connecting elements, extend continuously through both individual blocks.

6. The method according to claim 4, wherein the railroad tie reinforcement comprises grid supports each including three longitudinal rods which form edges of a triangular prism and two meandering coils connecting the longitudinal rods.

7. The method according to claim 5, wherein the railroad tie reinforcement comprises grid supports each including three longitudinal rods which form edges of a triangular prism and two meandering coils connecting the longitudinal rods.

8. A railroad tie for installation above a hydraulically bound supporting layer comprising:

a partially constructed concrete casing;

a continuous railroad tie reinforcement having a portion which protrudes below out of the partially constructed concrete casing;

a supporting reinforcement between the continuous railroad tie reinforcement and the hydraulically bound supporting layer;

a casting composition disposed on the hydraulically bound supporting layer, said concrete casing along with said protruding portion of said continuous railroad tie reinforcement being embedded within said casting composition;

an upper side of the partially constructed concrete casing including inclined stripping edges for the casting composition which extend from one end of the railroad tie to the other, inclined to a running plane of the rails.

9. The railroad tie according to claim 8, wherein the upper side of the partially constructed concrete casing is constructed as an inclined plane, with the exception of a portion thereof defining a rail fastening hump.

10. The railroad tie according to claim 8, wherein the inclination of the stripping edge is about 1%.

11. The railroad tie according to claim 9, wherein the inclination of the stripping edge is about 1%.

12. The railroad tie of claim 8, further comprising a height adjusting marking disposed on a portion of the upper side of the partially constructed concrete casing.

13. The railroad tie of claim 8, further comprising a length adjusting marking disposed on a portion of the upper side of the partially constructed concrete casing.

14. A method of installing a railroad track above a hydraulically bound supporting layer comprising:

providing a partially constructed railroad tie for carrying rails, constructing said partially constructed railroad tie by forming a concrete casing provided with a railroad tie reinforcement disposed such that a protruding portion of said railroad tie reinforcement protruders from the bottom of said concrete casing;

pre-assembling a plurality of said partially constructed railroad ties and tracks into a pre-assembled rail grid above said hydraulically bound supporting layer;

interposing a supporting reinforcement between the supporting layer and the rail grid;

applying a casting composition between the supporting layer and the partially constructed railroad ties;

embedding said protruding portion of said railroad tie reinforcement within said casting composition; and providing a connection between said supporting reinforcement and the protruding portion of said railroad tie reinforcement prior to applying said casting material.

15. The method according to claim 14, wherein:

disposable and embedded angle irons supported on the hydraulically bound supporting layer and are used for alignment of the concrete railroad ties in the rail grid.

16. The method according to claim 15, wherein:

the angle irons include threaded boreholes for accommodating vertically and horizontally adjusting spindles.

17. The method according to claim 14, comprising:

utilyzing adjusting spindles to vertically and horizontally adjusting the railroad ties.

18. A method for installing a steady rail track, comprising:

providing concrete railroad ties for carrying rails, each concrete railroad tie including a continuous railroad tie reinforcement which protrudes below out of a partially constructed concrete casing;

pre-installing the concrete railroad ties by arranging the concrete railroad ties into a rail grid and aligning the rail grid directly over a hydraulically bound supporting layer;

interposing a supporting reinforcement between the supporting layer and the raid grid;

aligning the height and a side of each of the concrete railroad ties comprising the grid via adjusting spindles; and applying a casting composition on the hydraulically bound supporting layer to embed the concrete railroad ties in the casting composition.

19. The method according to claim 18, wherein:

disposable and embedded angle irons are supported at the hydraulically bound supporting layer are used for alignment of the concrete railroad ties in the rail grid;

the adjusting spindles include vertically and horizontally adjusting spindles; and the angle irons include threaded boreholes for accommodating the vertically and horizontally adjusting spindles.

20. A railroad tie for installation above a hydraulically bound supporting layer comprising:

a concrete casing;

a railroad tie reinforcement having a portion which protrudes below out of the concrete casing;

a supporting reinforcement between the railroad tie reinforcement and the hydraulically bound supporting layer; and a casting composition disposed on the hydraulically bound supporting layer, said concrete casing along with said protruding portion of said railroad tie reinforcement being embedded within said casting composition.

* * * * *